US006250423B1

(12) United States Patent
Bartsch

(10) Patent No.: US 6,250,423 B1
(45) Date of Patent: Jun. 26, 2001

(54) MOBILE LIFTING PLATFORM

(75) Inventor: Marius Bartsch, Ahlen (DE)

(73) Assignee: Bison Stematec Maschinenbau- und Hubarbeitsbuhnen Produktiongesellschaft mbH (DE)

( * ) Notice: Subject to any disclaimer, the term of this patent is extended or adjusted under 35 U.S.C. 154(b) by 0 days.

(21) Appl. No.: 09/523,038

(22) Filed: Mar. 10, 2000

Related U.S. Application Data

(63) Continuation of application No. 08/861,719, filed on May 22, 1997, now abandoned.

(30) Foreign Application Priority Data

Jun. 17, 1996 (DE) ..... 296 10 630 U

(51) Int. Cl.[7] ..... E04G 1/00; E04G 3/00
(52) U.S. Cl. ..... 182/2.1; 182/65.1; 182/2.3
(58) Field of Search ..... 182/2.1, 2.9, 65.1; 212/245, 223, 221, 233, 247, 248, 246

(56) References Cited

U.S. PATENT DOCUMENTS

| | | |
|---|---|---|
| 1,528,222 | 3/1925 | Miller . |
| 3,085,648 | 4/1963 | Benedetto . |
| 3,533,515 | 10/1970 | Milner, Jr. . |
| 3,791,484 | 2/1974 | Harrison . |
| 4,116,304 | 9/1978 | Durnell . |
| 4,596,508 | 6/1986 | Kiski et al. . |
| 4,674,638 | 6/1987 | Oliphant . |
| 5,518,128 | 5/1996 | Kroll et al. . |

FOREIGN PATENT DOCUMENTS

| | | |
|---|---|---|
| 287971 | 2/1971 | (AU) . |
| 1960829 | 12/1966 | (DE) . |
| 2053570 | 5/1971 | (DE) . |
| 26 53 951 | 9/1983 | (DE) . |
| 41 23 398 | 1/1993 | (DE) . |
| 1278537 | 1/1972 | (GB) . |
| 1544564 | 4/1979 | (GB) . |
| 2079243 | 1/1982 | (GB) . |

*Primary Examiner*—Daniel P. Stodola
*Assistant Examiner*—Hugh B. Thompson
(74) *Attorney, Agent, or Firm*—Chernoff Vilhauer McClung & Stenzel

(57) ABSTRACT

A mobile lifting platform with a chassis and supports for a platform. Mounted on the platform is a first live ring whose vertical axis is approximately centered on the platform. The first live ring carries a horizontal boom which is pivotally movable about the axis and has an axis offset therefrom on which a second live ring is mounted which carries a swivel structure terminating in a boom, on the distal end of which a work platform or basket is mounted. The swivel structure is pivotally movable about a vertical axis of the second live ring. The swivel structure is connected to the horizontal boom in such a manner that they counterrotate.

7 Claims, 3 Drawing Sheets

MOBILE LIFTING PLATFORM

This is a continuation of application Ser. No. 08/861,719 filed May 22, 1997, now abandoned, and claims the benefit of German Patent Application No. 2961030.5 filed Jun. 17, 1996.

BACKGROUND OF THE INVENTION

The present invention relates to a mobile lifting platform comprising a chassis as well as platform support means on which a first live ring or turntable is mounted. Said live ring has its vertical axis approximately centered on said platform and supports a horizontal boom for pivotal movement about said axis. On said horizontal boom in turn there is mounted a second live ring or turntable whose axis is offset from that of the first live ring. Moreover, a swivel structure is attached to said second live ring for pivotal movement about a vertical axis thereof, which swivel structure terminates in a boom carrying a platform or basket for workmen at its distal end.

Mobile lifting platforms of this type are in keeping with the proposed European standard prEN 280 of April 1994, as drafted by the "Technisches Komitee" (technical committee) CEN/TC 98/AG 1of the "Europäisches Komitee für Normung" (European standards committee). Such mobile lifting platforms may be provided in the form of a trailer or as self-propelled machines.

Attempting to provide mobile lifting platforms which are short in total length and thus pose no maneuvering problems when used in traffic, complex multiple telescope systems as well as a pronounced bend of the swivel structure have been proposed in the prior art in order to make use of the area above the driver's cabin. Owing to the pronounced bend of the swivel structure, said structure—once swivelled—will exceed the overall width of the vehicle, thus projecting into the traffic area. Proximal support means are traditionally provided immediately behind the driver's cabin. As a consequence, the range or radius of the lifting means to the front must be limited in order to ensure steadiness and stability of the overall vehicle in operation.

A further disadvantage of the prior art is the common general necessity to use support means or stabilizers which may be telescopically extended or unfolded over the width of the vehicle since these likewise pose a traffic obstacle in operation, yet are required for operational safety.

German patent application DE 1,960,829 A1 discloses a mobile lifting platform with two live rings. The movement of said live rings is separately controlled via two drive units which are independent of each other. Such an arrangement is said to facilitate the reaching of positions which are outside the vehicle range.

It is the object of the present invention to provide a lifting platform of the aforementioned type in which fewer telescopic means are used with the same overall vehicle length and which facilitates movement of the lifting platform itself, at the same time leaving more space for passing traffic both when the lifting platform is being moved into position and when it is in operation.

SUMMARY OF THE INVENTION

According to the invention this object is accomplished by the features of the main claim.

Advantageous embodiments of the invention are described in the subclaims.

The present invention also makes use of the basically known bent swivel structure which, however, may in this case be of a larger size than with comparable lifting platforms in order to use the free area e.g. above the driver's cabin and reduce the overall length of the machine. A reduction of the machine's overall length also results in a shift of its gravity centre which in turn results in a short wheel base - which enhances the manoeuverability of the lifting platform in traffic. Moreover, due to the shift of the gravity centre, the radius or range of the swivel structure to the front above and beyond the driver's cabin of the carrier vehicle is increased considerably.

The fact that the swivel structure is bent more than in the prior art is compensated in that pivoting occurs about two offset pivot axes which are connected with each other so as to be forced to move in opposed directions. To this end, the swivel structure is connected to the horizontal boom such that the directions of the rotary movements of these two parts are opposed to each other. Advantageously, such opposed movement between said swivel structure and said horizontal boom is effected via a gear acting between the two elements, with the opposite angular velocities between the horizontal boom and the swivel structure being approximately of the same amount. This ensures that the vehicle contours will not exceeded in most cases. Moreover, a uniform load acts on the supports or stabilizers and/or the carrier vehicle. In addition, the fact that the horizontal boom and the swivel structure rotate in opposite directions advantageously results in a reduction by approx. 50 % of the gear driving torques.

Furthermore, the distance between the two rotary axes may advantageously be balanced out using a counterweight. As a consequence, the gravity centre is mostly within the narrow dimensions of support means which should not exceed the size of the vehicle, if possible. Also, the bent part is dimensioned according to the invention such that, when the carrier vehicle is in operation, said part rests above a driver's cabin on the one hand and does not exceed the overall vehicle width, on the other.

The known support means also used in the present invention may be made to extend beyond the area taken up by the platform, if necessary, although in most cases, unilateral support will be sufficient.

Further details, features and advantages of the present invention may be gathered from the description hereinafter of an embodiment example which is also shown in the drawings, in which

DETAILED DESCRIPTION OF THE PREFERRED EMBODIMENT

Figure 1:
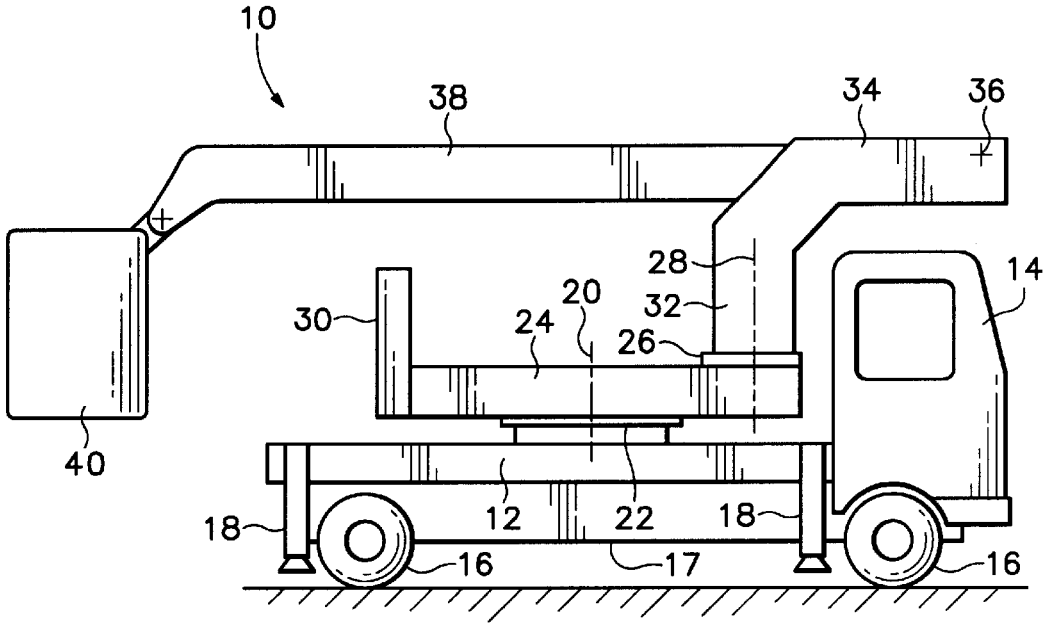
FIG. 1 is a side view of a self-propelled lifting platform in its usual drive position.

The embodiment example shown in the drawings is a self-propelled lifting platform 10. When the machine is driven, a platform 12 is supported by a chassis of which only wheels 16 are shown. For supporting the machine in operation, support means with extendable supports or stabilizers 18 are provided. It should be noted in this respect that such support means normally need only be provided vertically at the four outer corners of the platform 12.

On the platform 12, i.e. mounted centrally on the platform surface or centrally between the four supports or stabilizers 18 is a live ring 22 which is stationary, i.e. connected to platform 12, and which has a vertical rotary axis 20. A horizontal boom 24 is pivotally movable about said vertical axis 20 of said live ring 22. However, said live ring 22 may also be mounted at a position offset from the centre of said platform 12. On one end of said horizontal boom 24 there is mounted a second live ring 26 having a rotary axis 28. The other end of said horizontal boom 24 carries a counterweight 30.

The second live ring 26 supports a swivel structure 32 which—in the embodiment shown—terminates in a bent fork 34. Mounted on the free end of said fork 34 is a horizontal joint 36 in which a boom 38 is mounted for pivotal upward and downward movement. Of course, said boom 38 may also be telescopable. On the distal end of said boom a work platform or basket 40 is usually mounted.

Figure 5:
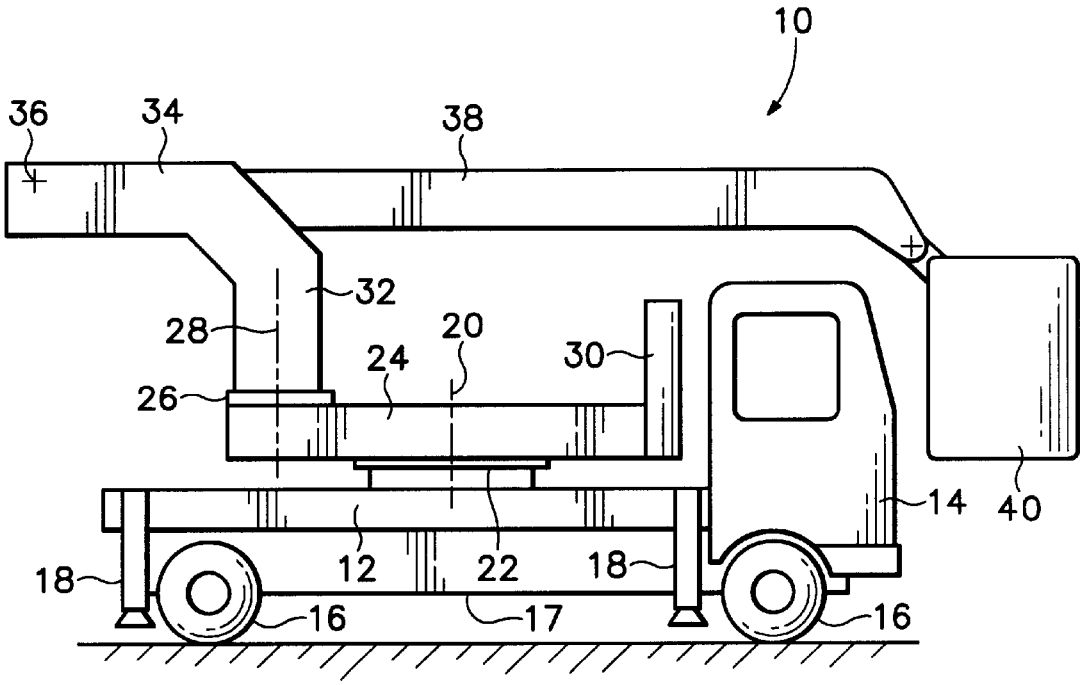
FIG. 5 is a side view of the self-propelled lifting platform in a position in which the work platform or basket is positioned in front of the driver's cabin.

As is viewable from FIGS. 1 and 5, the self-propelled machine may both be driven with the work platform or basket 40 positioned at the rear, as is common, and with said work platform or basket 40 in front of the driver's cabin in order to keep the vehicle length as short as possible in transit.

Figure 2:
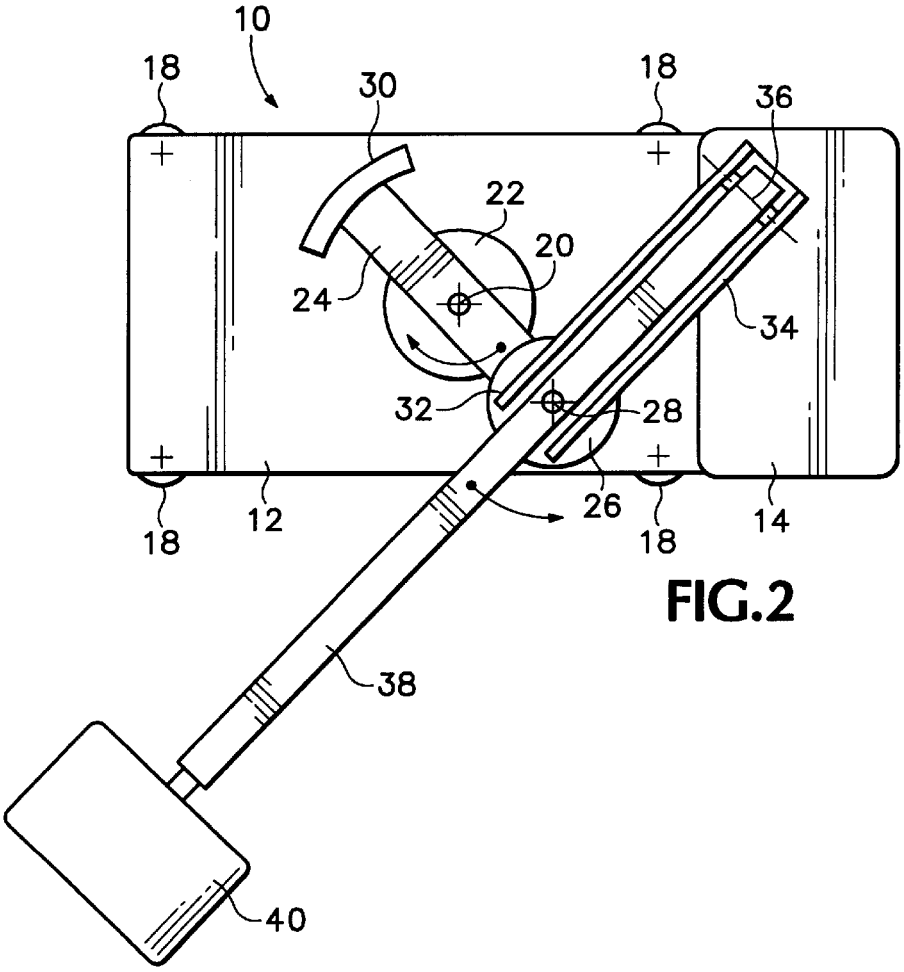
FIG. 2 is a top view of said platform in its operational state, with its lifting means being pivoted to a 45° position.
Figure 4:
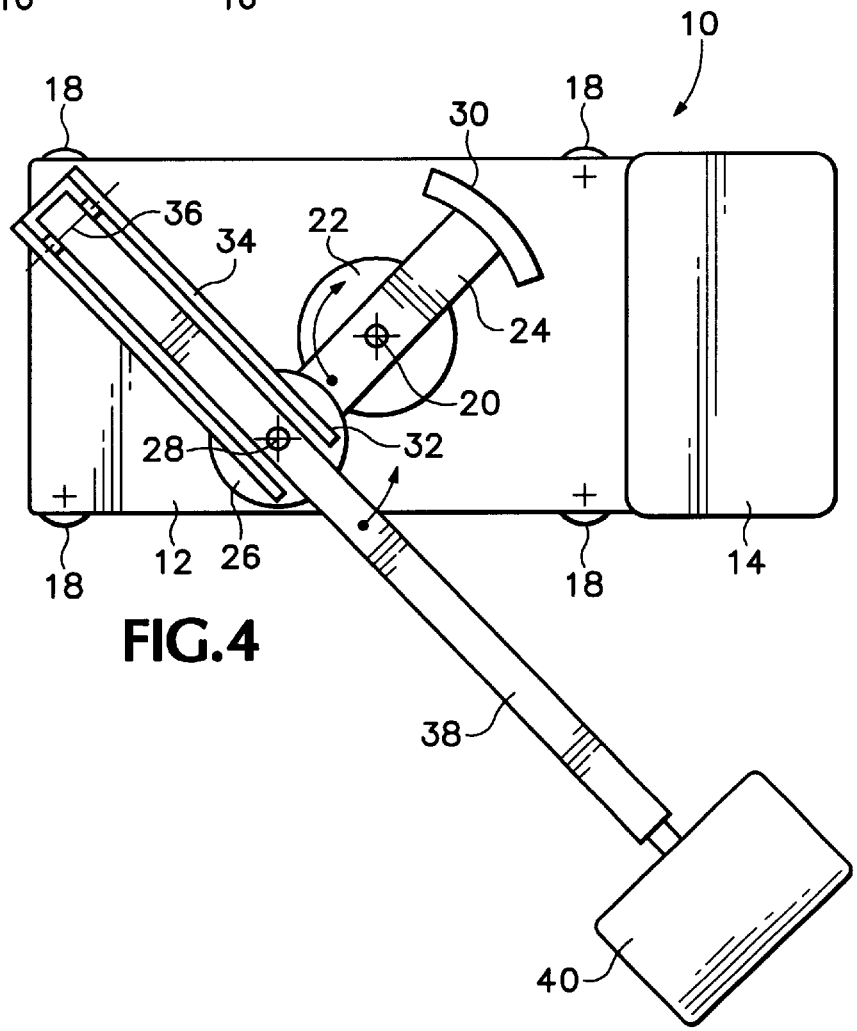
FIG. 4 is a top view of an operational position other than that of FIG. 2.
Figure 6:
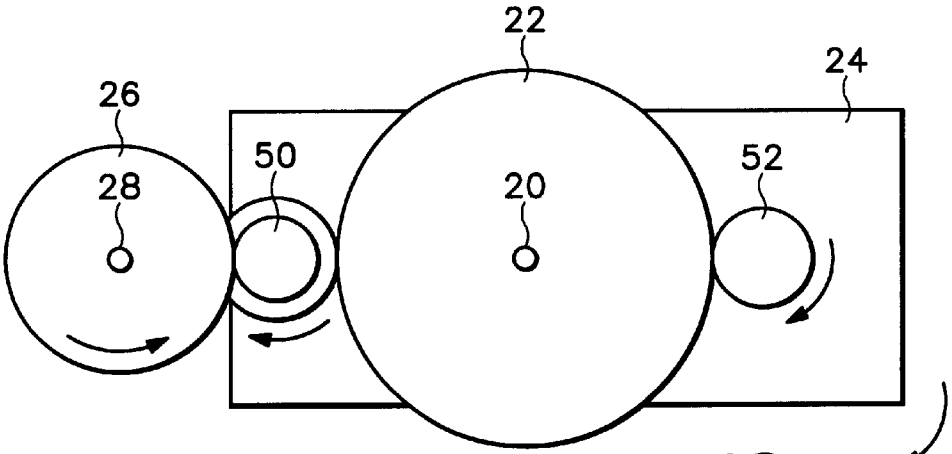
FIG. 6 is a schematic plan view of the horizontal boom, live rings, and coupling gear.

With reference to FIGS. 2 and 4, said second live ring 26 and the structure it supports, i.e. mainly boom 38, which is pivotally movable about axis 28, on the one hand, and said horizontal boom 24 which is pivotally movable about axis 20, on the other—are connected resulting in a counterrotational movement. These elements are connected in such a manner that their rotary movements are in the directions indicated by the arrows in the drawings. The rotary connection is obtained by means of a gear 50 within said horizontal boom 24 which is shown in FIG. 6. Such gear may be of any positive or interlocking type, in particular a connection via toothed gearing or a friction connection, a belt or chain type connection which preferably travels along, rolls off or unwinds along a stationary closed circular arc. This simultaneous and opposed pivotal movement of swivel structure 32 against the pivotal movement of horizontal boom 24 may be obtained in several different ways. Axis 20 or axis 28 may be driven to this end. Preferred is a coupling of movements in which one of the two toothed rings 22 or 26 is stationary and the driven part unwinds along this toothed ring of the stationary part via at least one gear reducer pinion. As a consequence, a rotary movement initiated via axis 28 would result in a pivotal movement of swivel structure 32 together with boom 38 as well as in a forced movement of horizontal boom 24 in the opposite direction. The opposite angular velocities of these two movements are of the same amount. This may for example be achieved by means of a gear in which the driven second live ring 26 meshes with a toothed wheel via a gear reducer pinion of random diameter and unwinds along an opposing stationary toothed ring.

Said rotary movement may also be usefully initiated by means of a motor 52, via axis 20 of said first live ring 22. In this case, said second live ring 26 would be fixed.

Figure 3:
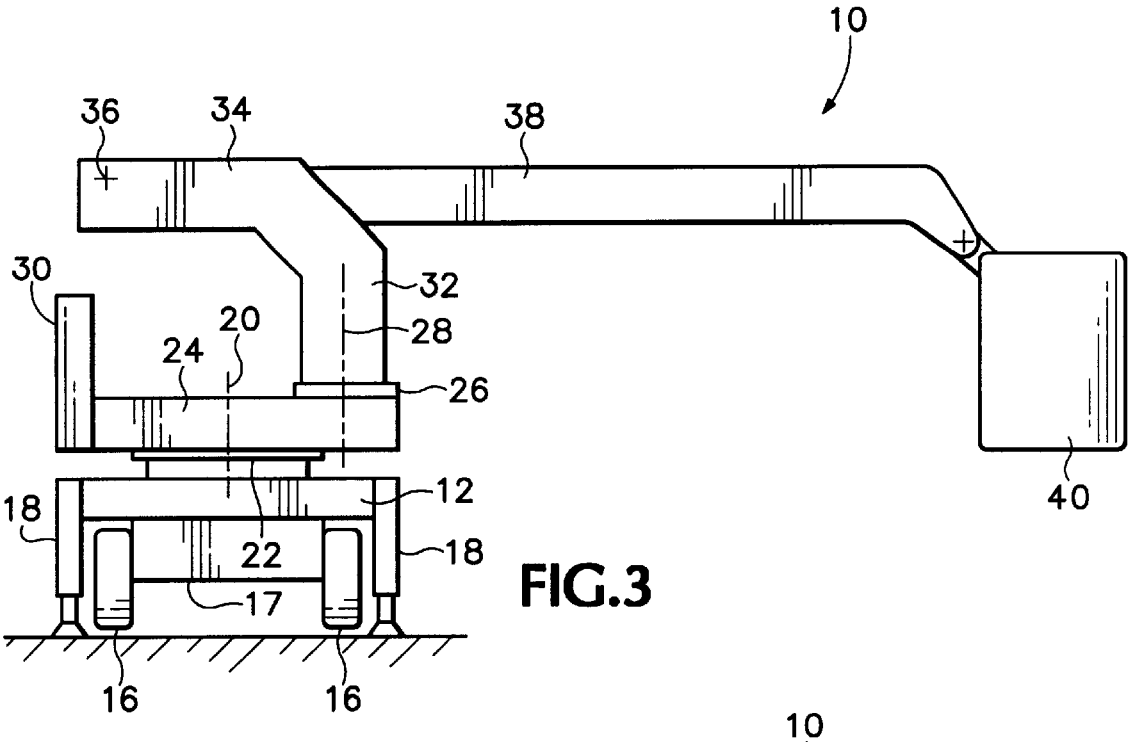
FIG. 3 is a view from the rear, with a boom being extended to its farthest optimum position.

With reference to FIG. 3, the counterweight 30 will always lie within the area of platform 12 even if the longitudinal boom of said platform 12 is extended at right angles—which means that e.g. in this operational position any traffic may pass the machine unhinderedly on the side of the counterweight. Such a position may be important for example when work is done on the side of bridge rails.

In all other positions sufficient space will remain for traffic to pass the machine unhinderedly, even if the bent part of the fork 34 extends into the traffic area. In the diagonal positions shown in more detail in FIGS. 2 and 4, traffic passing the machine on the side will not be obstructed anyway, while on the side of the work platform or basket 40 enough space will be left underneath said boom 38 for traffic to pass.

What is claimed is:

1. A mobile lifting platform, comprising:

(a) a longitudinally extending chassis supporting a platform and an elevated driver's cabin mounted forward of said platform and extending above said platform;

(b) a first live ring mounted on said platform having a vertical axis approximately centered on said platform;

(c) said first live ring supporting a horizontal boom pivotable about said vertical axis of said first live ring;

(d) a second live ring having a vertical axis mounted on said horizontal boom, said second live ring being mounted at a location on said horizontal boom such that said vertical axis of said second live ring is offset from said vertical axis of said first live ring, said second live ring supporting a vertically extending swivel structure having an upper portion vertically offset from said vertical axis of said second live ring supporting a second boom, said second boom supporting on a distal end a work platform; and (e) said swivel structure being pivotally movable about said vertical axis of said second live ring wherein said swivel structure is coupled with said horizontal boom in such a manner that said swivel structure and said horizontal boom counter-rotate.

2. The lifting platform as claimed in claim 1 wherein the counterrotation of said swivel structure and said horizontal boom is obtained by means of a gear acting between the two.

3. The lifting platform as claimed in claim 1 wherein the counterrotational angular velocities between said horizontal boom and said swivel structure are of the same amount.

4. The lifting platform as claimed in claim 1 wherein a weight of said horizontal boom is balanced out by means of a counterweight.

5. The lifting platform as claimed in claim 4 wherein the distance between said axis of said second live ring and said axis of said first live ring, as well as the distance between said axis of said first live ring and said counterweight are of the same amount.

6. The lifting platform as claimed in claim 1 wherein said upper portion comprises a bent fork having an elevated portion that is capable of being pivoted over said cabin.

7. The lifting platform as claimed in claim 6 wherein, when said boom is positioned longitudinally with respect to said chassis, said bent fork extends above and beyond said driver's cabin.

* * * * *